US006901757B2

(12) United States Patent
Gerendas

(10) Patent No.: US 6,901,757 B2
(45) Date of Patent: Jun. 7, 2005

(54) HEAT SHIELD ARRANGEMENT WITH SEALING ELEMENT

(75) Inventor: Miklos Gerendas, Zossen (DE)

(73) Assignee: Rolls-Royce Deutschland Ltd & Co KG, Duhlewitz (DE)

( * ) Notice: Subject to any disclaimer, the term of this patent is extended or adjusted under 35 U.S.C. 154(b) by 0 days.

(21) Appl. No.: 10/291,425

(22) Filed: Nov. 12, 2002

(65) Prior Publication Data

US 2003/0089115 A1 May 15, 2003

(30) Foreign Application Priority Data

Nov. 12, 2001 (DE) ..... 101 55 420

(51) Int. Cl.[7] ..... F02C 7/24
(52) U.S. Cl. ..... 60/752; 60/755; 110/336
(58) Field of Search ..... 60/752, 753, 754, 60/755, 756, 757, 758, 759, 760; 110/336, 337, 338, 339, 340; 431/243, 353

(56) References Cited

U.S. PATENT DOCUMENTS

| | | | | |
|---|---|---|---|---|
| 3,295,280 A | * | 1/1967 | Kettner | 110/336 |
| 4,441,324 A | | 4/1984 | Abe et al. | |
| 4,555,901 A | * | 12/1985 | Wakeman et al. | 60/757 |
| 4,768,447 A | * | 9/1988 | Roumeguere | 110/336 |
| 4,838,031 A | | 6/1989 | Cramer | |
| 5,079,915 A | * | 1/1992 | Veau | 60/766 |
| 5,083,424 A | | 1/1992 | Becker | |
| 5,176,495 A | | 1/1993 | Honkomp et al. | |
| 5,333,443 A | * | 8/1994 | Halila | 60/752 |
| 5,560,197 A | | 10/1996 | Ansart et al. | |
| 5,755,093 A | * | 5/1998 | Palusis et al. | 60/266 |
| 5,957,067 A | * | 9/1999 | Dobbeling et al. | 110/336 |
| 6,270,311 B1 | * | 8/2001 | Kuwabara et al. | 415/110 |
| 6,470,685 B2 | * | 10/2002 | Pidcock et al. | 60/752 |
| 6,675,586 B2 | * | 1/2004 | Maghon | 60/755 |
| 2003/0021675 A1 | | 1/2003 | Tiermann | |

FOREIGN PATENT DOCUMENTS

| | | |
|---|---|---|
| DE | 3112839 | 1/1982 |
| DE | 10003728 | 8/2001 |
| EP | 1118806 | 7/2001 |
| EP | 1130219 | 9/2001 |
| GB | 2075659 | 11/1981 |
| WO | 89/12789 | 12/1989 |
| WO | 01/55273 | 8/2001 |
| WO | 01/65073 | 9/2001 |

* cited by examiner

*Primary Examiner*—Ted Kim
(74) *Attorney, Agent, or Firm*—Harbin King & Klima

(57) ABSTRACT

A heat shield arrangement includes several tiles 1 and several fasteners 6 for attaching the tiles at a spaced distance to a wall 2 to form an interspace 4 between the wall and the tiles which can be supplied with cooling air. At least one sealing element 3 is positioned between adjacent tiles 1 to provide a seal between rims 5 of the adjacent tiles 1. The rims 5 of the tiles 1 which are to be sealed are maintained at a spaced distance from the wall 2 by the fasteners 6 and the sealing element 3 is positioned remotely from the wall 2 and in abutment with the rims 5 of the tiles 1, with the sealing element 3 being allowed to float over the rims 5.

25 Claims, 2 Drawing Sheets

HEAT SHIELD ARRANGEMENT WITH SEALING ELEMENT

This application claims priority to German Patent Application DE10155420.6, filed Nov. 12, 2001, the entirety of which is incorporated by reference herein.

BACKGROUND OF THE INVENTION

This invention relates to a heat shield arrangement with several tiles each being located on a wall and with at least one sealing element arranged between adjacent tiles, with the tiles being separated from the wall to form an interspace which can be supplied with cooling air.

The heat shield arrangement applies to a hot-gas conducting structure, in particular a metallic component of a gas turbine system or a gas turbine combustion chamber.

It is known from the state of the art that combustion chamber components, for example heat shields or tiles, are attached to the wall of a combustion chamber by a threaded connection without the use of sealing elements. Connection is accomplished by a bolt, with the rims of the tile directly abutting the wall of the combustion chamber. No sealing element is used in this type of connection.

Generally, these designs are disadvantageous in that the tiles rise from the wall of the combustion chamber under thermal load. The gap so formed allows cooling air to leak. Such leakage further increases the temperature of the tiles and, in turn, the gap at the tile rim. Ultimately, failure of the tiles or heat shields will occur.

From other designs, so-called strip seals are known. These strip seals are fitted into lateral slots between adjacent tiles or heat shields to seal them against each other. A design of this type is shown in Specification DE 10 003 728, for example. Here, seals of this type are provided as checkered plates which fit into corresponding lateral grooves in the tiles.

Clamp-type seals are known from Specification EP 1 130 219 A1 which engage grooves in the heat shield from the side opposite the hot gas. Here, the seal element can also be bellows-type or multi-part. Relative movement of the heat shields is ensured by the legs of the essentially U-shaped seals deforming during the operation of the gas turbine system.

The above seals, which are fitted into lateral slots, are disadvantageous in terms of assembly and cooling. The seals must be fitted into the slots after the tiles have been installed and must be secured against displacement. This process incurs high effort and may be technically critical, in particular where the accessibility of the sealing slots of individual tiles is restricted. These designs are further disadvantageous in that cooling air cannot adequately be supplied to the areas of the tiles which lie above the seals and their respective slots.

This applies in particular for seals according to EP 1 130 219 A1, where the area of two adjacent heat shields between the slots for the clamp-type seal cannot be supplied with air for the preferred method of effusion or transpiration cooling. In addition, the seal has a large radial extension and is, therefore, not flexible in the axial direction. Differences in thermal expansion along the tile edge due to temperature gradients or radial deformation for other reasons will compromise the quality of the seal.

A further problem dealt with in the present invention is that the conventional tiles are bolted rigidly to the wall of the combustion chamber. The bolt used here is normally a threaded bolt which is secured by a washer and nut. This rigid connection is associated with a significant increase of the mechanical stresses in the component. Under increasing temperatures, these stresses may easily exceed the permissible values, with cracks forming in the material of the wall of the combustion chamber.

SUMMARY OF THE INVENTION

In a broad aspect this invention provides a heat shield arrangement of the type described at the beginning which combines adequate cooling capacity and high life with simple design and straightforwardness and reliability of function.

It is a particular object of the present invention to provide remedy to the above problems by the features described herein, with further objects and advantages of the present invention becoming apparent from the description below.

First, the present invention is characterized by the fact that the rims of the tiles to be sealed are kept or maintained at a certain spaced distance from the wall by means of fasteners and that the sealing element is fitted remotely from the wall and in abutment with the rims of the tiles, with the seal being allowed to float on these rims.

The tile arrangement according to the present invention features a variety of merits.

Since the seal is not inserted into slots in the tiles, but is installed between the tile and the wall, the rims of the tile will, as a decisive advantage, not come into contact with the wall. Rather, the rims are kept at some distance from the wall by the fasteners provided. Thus, the seal will always abut both of the tiles and an adequate flow of cooling air will be maintained also in the area of the seals.

Adequate sealing will be guaranteed by this arrangement even if the tiles (or the wall) deform under the influence of heat.

It is particularly advantageous to secure the sealing element by lateral retainers. These retainers prevent the sealing element from being displaced, i.e., the sealing element is reliably secured in operation even when exposed to vibrations or similar influences, with the lateral retention of the sealing element providing for sufficient play to compensate for any relative movement of two adjacent tiles by allowing the sealing element to float on the tile rims.

For adequate resilience of the entire sealing arrangement, it can be advantageous to interspace the lateral retainers along the length of the sealing element.

Summarizing, then, the present invention provides for a more effective use of the cooling air. This, in turn, leads to a reduction of the operating temperature of the tiles. As a result, the life of the entire heat shield arrangement will be enhanced. Further, the consumption of cooling air can be reduced, thus increasing the total efficiency of the gas turbine.

As regards the attachment of the tiles, the present invention provides for a fastener in the form of a bolt (the term bolt including a stud) which passes through an opening in the wall. Provision is here made for at least one resilient element to be inserted (positioned) on at least one side of the wall, thus permitting the tile to move angularly to the wall. In a preferred development of the present invention, it is also possible to provide at least one resilient element on both sides of the wall.

The inventive design, which, fully independently of the sealing arrangement described above, may also be used for other forms of tiles, has the following advantages without being limited to these:

Movement and angular variation between the tile and the wall of the combustion chamber, even if minor, will significantly reduce the stress level in the tile. Such movability is guaranteed by the design according to the present invention. Appropriate travel is ensured by a resilient element arranged (positioned) in the area of the opening of the wall, which, of course, must be somewhat larger in diameter than the outer diameter of the bolt. Also, this movability can be achieved without enlarging the wall surface required for installation. Further, it can be ensured that the aerodynamic properties of the tile are not affected by this movability. Accordingly, the cooling airflows as well as the cooling efficiency are not compromised on the whole.

With the resilient element, it is possible to retain the bolt elastically and to seal it gas-tight. The resilient element is in this case also a sealing element.

In a further advantageous form of the present invention, the resilient element also has vibration damping properties, for example by the friction between several resilient elements provided as a set and/or the wall and the surface of the tile.

This design will reduce the load of the component, which may be used beneficially both for increasing its life and also for raising the permissible temperature.

It is further advantageous that a less expensive and less demanding material can be used for the tiles.

BRIEF DESCRIPTION OF THE DRAWINGS

This invention is more fully described in the light of the accompanying drawing showing preferred embodiments. On the drawings.

DETAILED DESCRIPTION OF THE INVENTION

Figure 1:
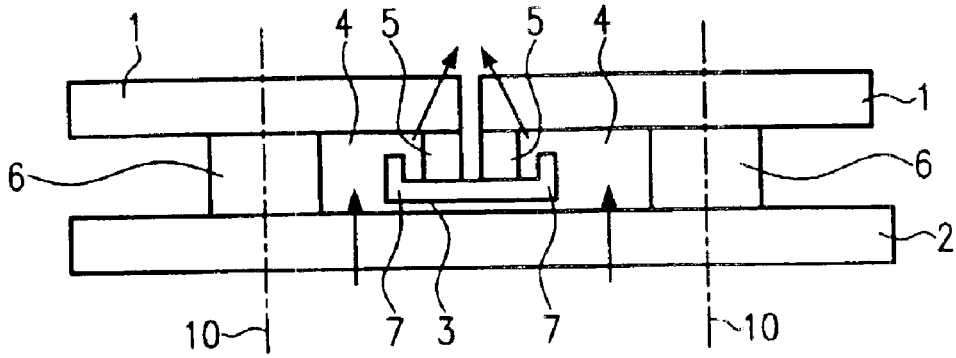
FIG. 1 is schematic cross-sectional view of the heat shield arrangement with sealing elements according to the present invention.

This detailed description should be read in conjunction with the details provided in the summary of the invention section above.

In the embodiments, the reference numerals apply to the same respective items.

FIG. 1 is a schematic cross-sectional view of a wall 2, for example of a combustion chamber. Several tiles 1 are installed adjacent to each other on this wall, for example by means of fasteners 6. The assembly axes are each indicated by the reference numeral 10.

As becomes apparent from FIG. 1, the tiles are spaced at their adjacent rims 5.

An interspace 4 is provided between the wall 2 and the tile 1 through which cooling air is passed. The arrowheads schematically represent the cooling airflows. As becomes apparent, the seal according to the present invention will in no way impair effusion or transpiration cooling in the area of the tile rim. As regards the design of the cooling air ducts, any passages or the like, reference is made to the state of the art, dispensing with a further representation herein.

As can be seen from FIG. 1, the cross-section of the interspace 4 is sized such that the rims 5 of the tiles 1 will not come into contact with the wall 2. Rather, a strip-shaped or plate-shaped sealing element 3 is arranged underneath the rims 5, this sealing element being secured by lateral retainers 7 provided on the sealing element.

As becomes apparent from the representation, adequate sealing is ensured even under the influence of thermal expansion or displacement of the tiles, with the sealing element always being forced against the rims of the tile by the pressure difference over the tile. In particular, cooling air can adequately be supplied also to the rim area (rims 5) of the tiles 1.

Figure 2:
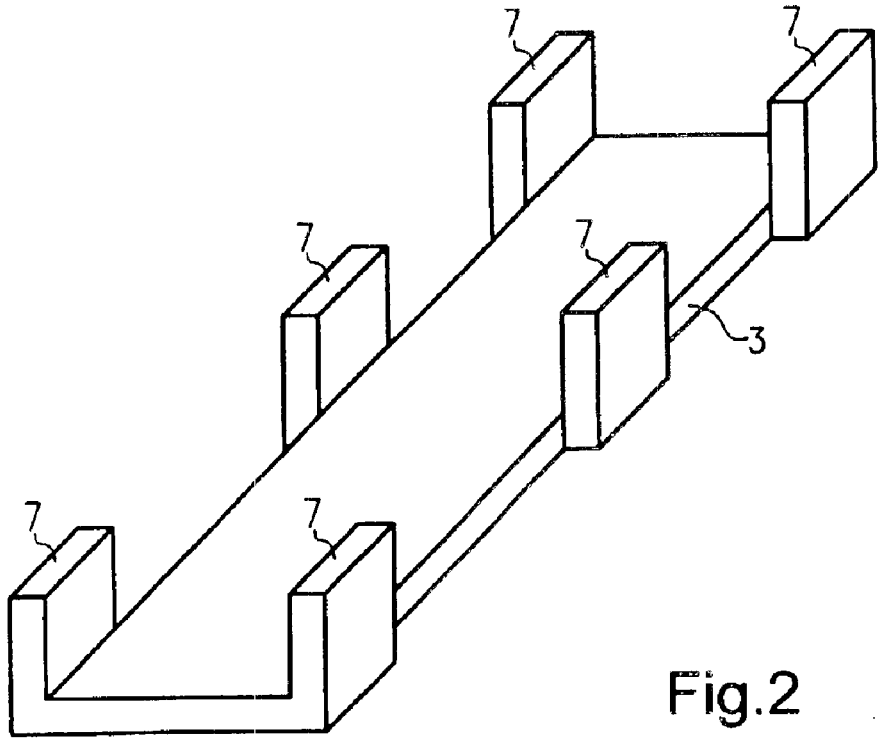
FIG. 2 is a perspective, simplified view of the interspaced retainers for the sealing element.

FIG. 2 shows, in simplified representation, a perspective view of the resilient, interspaced retainers 7. The segmentation of the lateral retainers 7 provides for a flexibility of the seal which is hardly inferior to that of a strip-type seal. Good sealing quality will be maintained even if the tile deforms under the influence of temperature gradients.

Figure 3:
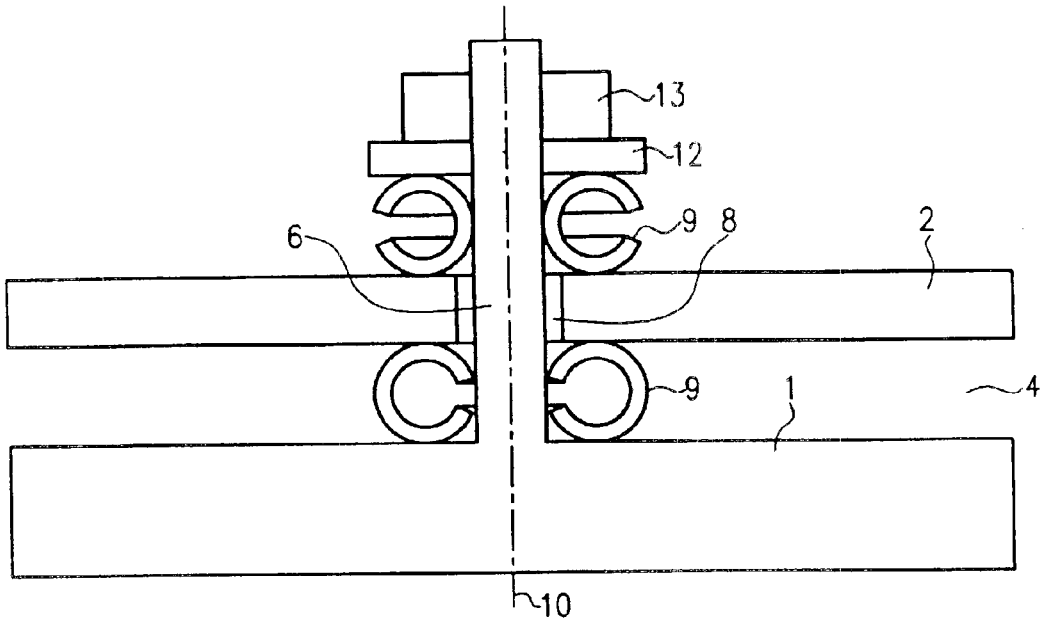
FIG. 3 is a simplified sectional view of the fastener with resilient elements according to the present invention.
Figure 4:
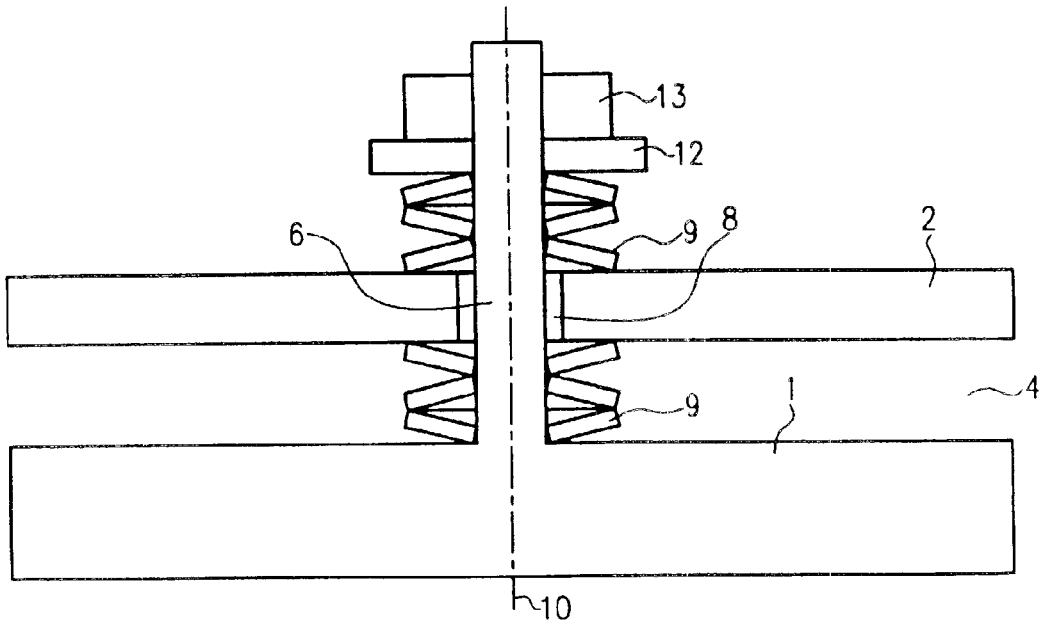
FIG. 4 is a view, analogically to FIG. 3, of a further embodiment.

FIGS. 3 and 4 show various designs of attachment by means of the fasteners. A threaded bolt is provided on the tile 1 which extends through an opening 8 in the wall 2. The diameter of the opening 8 is larger than the outer diameter of the fastener 6. The arrangement is secured by means of an external threading on the bolt 6 to which a nut 13 is fitted. In addition, a washer 12 is provided.

As shown in the embodiments, annular, resilient elements 9 are inserted both between the wall 2 and the tiles 1 and between the wall 2 and the washer 12. These can have a C-shaped cross-section, as shown in the embodiment of FIG. 3. This arrangement provides for sufficient resilience. The resilient elements 9 also provide for sealing which, in particular, can be gas-tight to prevent cooling air from leaking. By appropriate dimensioning, angular and lateral movability of the fastener 6 or the tile 1 relative to the wall 2 is provided.

In the embodiment shown in FIG. 4, the resilient elements 9 have the form of disc springs. These are additionally advantageous in that the friction between the individual spring discs produces a vibration damping effect.

It is understood that other designs of resilient elements can be used. Various combinations of the embodiments shown are also contemplated.

It is apparent that a plurality of modifications other than those described herein may be made to the embodiments here shown without departing from the inventive concept.

What is claimed is:

1. A heat shield arrangement comprising:

a plurality of tiles;

a plurality of fasteners attaching the plurality of tiles at a spaced distance to a wall to form an interspace between the wall and the tiles which can be supplied with cooling air;

each tile having a rim positioned at an edge of the tile and extending away from the tile toward the wall, an outermost portion of each rim facing toward the wall forming a sealing surface;

at least one sealing element arranged to contact the sealing surfaces of adjacently positioned rims of adjacent tiles to provide a seal between the adjacent tiles;

wherein the rims of the tiles which are to be sealed are maintained at a spaced distance from the wall by the fasteners and the sealing element is positioned remotely from the wall and in abutment with the sealing surfaces of the rims of the tiles, with the sealing element being allowed to float on the rims.

2. A heat shield arrangement in accordance with claim 1, wherein the sealing element includes a plurality of lateral retainers to secure the sealing element to the rims.

3. A heat shield arrangement in accordance with claim 2, wherein the lateral retainers only extend over a part of the length of the sealing element.

4. A heat shield arrangement in accordance with claim 3, wherein the tiles are positioned at a spaced distance from each other.

5. A heat shield arrangement in accordance with claim 4, wherein at least one of the fasteners includes a bolt which extends through an opening in the wall, and the arrangement includes at least one resilient element positioned on at least one side of the wall to provide for angular movability of the tile relative to the wall.

6. A heat shield arrangement in accordance with claim 5, including at least one resilient element positioned on each side of the wall.

7. A heat shield arrangement in accordance with claim 6, wherein the resilient element is a spring.

8. A heat shield arrangement in accordance with claim 7, wherein the resilient element is a sealing element.

9. A heat shield arrangement in accordance with claim 8, wherein the resilient element is a vibration-damping element.

10. A heat shield arrangement in accordance with claim 9, wherein a diameter of the opening is larger than an outer diameter of the bolt, thus providing for axial and circumferential movability of the tile relative to the wall.

11. A heat shield arrangement in accordance with claim 1, wherein the tiles are positioned at a spaced distance from each other.

12. A heat shield arrangement in accordance with claim 1, wherein at least one of the fasteners includes a bolt which extends through an opening in the wall, and the arrangement includes at least one resilient element positioned on at least one side of the wall to provide for angular movability of the tile relative to the wall.

13. A heat shield arrangement in accordance with claim 12, including at least one resilient element positioned on each side of the wall.

14. A heat shield arrangement in accordance with claim 12, wherein the resilient element is a spring.

15. A heat shield arrangement in accordance with claim 14, wherein the resilient element is a sealing element.

16. A heat shield arrangement in accordance with claim 15, wherein the resilient element is a vibration-damping element.

17. A heat shield arrangement in accordance with claim 12, wherein the resilient element is a sealing element.

18. A heat shield arrangement in accordance with claim 17, wherein the resilient element is a vibration-damping element.

19. A heat shield arrangement in accordance with claim 12, wherein the resilient element is a vibration-damping element.

20. A heat shield arrangement in accordance with claim 12, wherein a diameter of the opening is larger than an outer diameter of the bolt, thus providing for axial and circumferential movability of the tile relative to the wall.

21. A heat shield arrangement comprising:

a plurality of tiles;

a plurality of fasteners attaching the plurality of tiles at a spaced distance to a wall to form an interspace between the wall and the tiles which can be supplied with cooling air;

each tile having a rim positioned at an edge of the tile and extending away from the tile toward the wall, an outermost portion of each rim facing toward the wall forming a sealing surface;

at least one sealing element arranged to contact the sealing surfaces of adjacently positioned rims of adjacent tiles to provide a seal between the adjacent tiles;

wherein the rims of the tiles which are to be sealed are maintained at a spaced distance from the wall by the fasteners and the sealing element is positioned remotely from the wall and in abutment with the sealing surfaces of the rims of the tiles, with the sealing element being allowed to float on the rims, the sealing element including a plurality of lateral retainers to secure the sealing element to the rims.

22. A heat shield arrangement in accordance with claim 21, wherein the lateral retainers only extend over a part of the length of the sealing element.

23. A heat shield arrangement in accordance with claim 22, wherein the tiles are positioned at a spaced distance from each other.

24. A heat shield arrangement in accordance with claim 23, wherein at least one of the fasteners includes a bolt which extends through an opening in the wall, and the arrangement includes at least one resilient element positioned on at least one side of the wall to provide for angular movability of the tile relative to the wall.

25. A heat shield arrangement in accordance with claim 21, wherein the tiles are positioned at a spaced distance from each other.

* * * * *